US006280053B1

(12) United States Patent
Chien

(10) Patent No.: US 6,280,053 B1
(45) Date of Patent: Aug. 28, 2001

(54) MULTIPLE FUNCTION ELECTRO-LUMINESCENT NIGHT LIGHT DEVICES

(76) Inventor: Tseng-Lu Chien, 8F, No. 29, Alley 73, Lin-Shen Road, Shi-Chi Town, Taipei Hseng (TW)

( * ) Notice: Subject to any disclaimer, the term of this patent is extended or adjusted under 35 U.S.C. 154(b) by 0 days.

(21) Appl. No.: 09/158,503

(22) Filed: Sep. 23, 1998

(51) Int. Cl.[7] ..... F21S 9/00

(52) U.S. Cl. ..... 362/228; 362/20; 362/84; 362/157

(58) Field of Search ..... 362/20, 34, 84, 362/109, 116, 157, 183–185, 194–196, 208, 202; 302/228

(56) References Cited

U.S. PATENT DOCUMENTS

| | | | | |
|---|---|---|---|---|
| 1,044 | * | 12/1838 | Read | 362/161 |
| 2,809,316 | | 10/1957 | Jeges . | |
| 3,056,697 | | 10/1962 | Belfort . | |
| 3,061,716 | | 10/1962 | Benander . | |
| 3,307,030 | | 2/1967 | Francisco . | |
| 4,138,628 | | 2/1979 | Smith . | |
| 4,664,473 | | 5/1987 | Gannon . | |
| 4,927,376 | | 5/1990 | Dickie . | |
| 5,119,280 | * | 6/1992 | Yang | 362/191 |
| 5,469,342 | | 11/1995 | Chien . | |
| 5,572,817 | | 11/1996 | Chien . | |
| 5,599,088 | | 2/1997 | Chien . | |
| 5,601,358 | | 2/1997 | Chien . | |
| 5,611,621 | | 3/1997 | Chien . | |
| 5,662,408 | * | 9/1997 | Marischen | 362/226 |
| 5,667,394 | | 9/1997 | Chien . | |
| 5,667,736 | | 9/1997 | Chien . | |
| 5,683,164 | | 11/1997 | Chien . | |
| 5,688,038 | | 11/1997 | Chien . | |
| 5,692,825 | * | 12/1997 | Shalvi | 362/183 |
| 5,704,705 | | 1/1998 | Chien . | |
| 5,720,651 | | 2/1998 | Chien . | |
| 5,722,757 | | 3/1998 | Chien . | |
| 5,722,760 | | 3/1998 | Chien . | |
| 5,746,500 | | 5/1998 | Chien . | |
| 5,746,501 | | 5/1998 | Chien . | |
| 5,752,337 | | 5/1998 | Chien . | |
| 5,752,761 | * | 5/1998 | Pietruczynik et al. | 362/84 |
| 5,754,064 | | 5/1998 | Chien . | |
| 5,775,016 | | 7/1998 | Chien . | |

* cited by examiner

*Primary Examiner*—Thomas M. Sember
*Assistant Examiner*—Ismael Negron
(74) *Attorney, Agent, or Firm*—Gloria Tsui-Yip; Howard C. Miskin

(57) ABSTRACT

An electro-luminescent lighting arrangement includes at least one additional lighting element situated in a housing to provide a lighting device in which the lighting elements have different brightnesses and other lighting characteristics in order to perform different functions, such as providing a night light function as well as a flashlight, lantern, warning or indicator light, or lamp function.

1 Claim, 7 Drawing Sheets

MULTIPLE FUNCTION ELECTRO-LUMINESCENT NIGHT LIGHT DEVICES

BACKGROUND OF THE INVENTION

1. Field of the Invention

This invention relates to an electro-luminescent lighting arrangement having multiple functions, and in particular to an electro-luminescent night light device combined with additional lighting elements, the additional lighting elements having a different brightness and/or other lighting characteristics than the electro-luminescent element to enable the combined device to perform different lighting functions, such as serving as both a night light and a flashlight, indicator or warning light, lantern, or lamp.

2. Discussion of Related Art

Electro-luminescent lighting arrangements have been proposed for use in a variety of specific contexts, including illumination of footwear, headwear, backpacks, safety guides, moving objects, flying objects, containers, timepieces, and audio equipment, because of their flexibility, low power consumption, and low operating temperature, and their relative brightness, color choice, and wide viewing angle in comparison with other low power consumption devices.

The characteristic of low power consumption is particularly useful in the context of night lights. While the quality of light emitted by an electro-luminescent element is not well adapted for general illumination purposes, it is ideal for providing background illumination.

The purpose of such night lights is to provide low intensity illumination sufficient to enable a person to distinguish objects so as to be able to move about in a room or find items such as glasses, a refrigerator door, a light switch, or the snooze button on an alarm clock, or to comfort young children, while permitting sleeping and minimizing power consumption. Because of the quality of light emitted by electro-luminescent elements, their negligible power consumption in comparison with incandescent lights, their relative thinness and flexibility, wide viewing angle and color selection, and their ability to be cut into a variety of shapes, character, indicia, and logos, electro-luminescent elements offer significant advantages over incandescent lights for such purposes.

The problem addressed by the present invention is that such night lights are generally limited to home use in a static location. There are many situations where the soft lighting and negligible power consumption of electro-luminescent night lights would be useful, but where brighter lighting is also needed. While electro-luminescent lighting elements can be used in a wide variety of devices, such as the universal safety light described in copending U.S. patent application Ser. No. 08/746,381, filed Nov. 8, 1996, and now allowed, the situation occurs that if the consumer is faced with the choice, for example, of taking a safety light or a night light on a camping trip, or of stocking a cabin with night lights or kerosene lanterns, the consumer will of necessity choose the former, even though it might be nice in both situations to have a night light handy. In order to solve this problem, it is necessary to provide electro-luminescent night lights with additional functions (or, conversely, to provide conventional lighting devices with electro-luminescent night light functions).

A multiple function electro-luminescent night light arrangement is disclosed in copending U.S. patent application Ser. No. 08/925,122, filed Sep. 8, 1997 (herein incorporated by reference). In this multiple function night light arrangement, an electro-luminescent night light of the type disclosed in copending U.S. patent application Ser. No. 08/910,212, filed Aug. 13, 1997 (also herein incorporated by reference), is combined with an electrical outlet or wall mounted security device, switch board, decorative cover plate or board, or other devices in order to increase the versatility of the electro-luminescent night light arrangement. The present invention further increases the versatility of such an electro-luminescent night light arrangement by adding lighting elements other than electro-luminescent elements to the night light.

Copending application Ser. No. 08/959,463, filed Oct. 23, 1998, and also incorporated herein by reference, discloses various embodiments that combine electro-luminescent light arrangements with additional lighting elements. However, the additional lighting elements are part of a conventional electrical light fixture, whereas the present invention, in various embodiments, adds additional lighting elements to what is essentially a night light that can be plugged directly into an electrical outlet to serve as a night light or, alternatively, adds electro-luminescent lighting elements to electrically powered lamps and in addition nonelectrically powered lighting arrangements, thereby greatly extending the number of applications for the electro-luminescent concept.

In addition to the above-cited copending patent applications, a number of prior U.S. patents disclose use of electro-luminescent elements in night lights. These include U.S. Pat. Nos. 5,662,408, 4,927,376, 4,664,473, 4,138,628, 3,061,716, 3,056,697, 2,809,316, and 3,307,030. However, all of the night lights disclosed in these patents are unsuitable to be adapted to include additional lighting elements, and are in general limited to out-of-date glass type hard panel of single panel electro-luminescent lighting elements.

In contrast, the present invention combines flexible panel, strip, tube, or fiber type electro-luminescent lighting elements with additional lighting elements to provide lighting devices that achieve new levels of convenience and versatility. The additional lighting elements can be used to provide illumination in case of power failure, provide flash or warning light functions, or simply increase the attractiveness of the lighting provided by the night light by combining the soft light emitted by an electro-luminescent element with brighter light as desired or necessary. For example, the addition of lighting elements other than electro-luminescent elements to an electro-luminescent night light can permit the night light to be used both indoors and outdoors, in a variety of different environments, and for such diverse purposes as traffic control, camping, road construction, navigation, and emergency lighting, with power consumption being optimized when the electro-luminescent element is the only lighting element illuminated.

The additional lighting elements can include virtually any known type of lighting element, such as light emitting diodes and incandescent, fluorescent, cold cathode, mercury vapor, and halogen lighting elements, and even nonelectrically powered oil, chemical, gas and other fuel burning lamps of various types, as a result of which the night light of the invention can be used in a virtually unlimited number of different applications, combining the function of a night light with the functions of, for example, a table lamp, wall lamp, oil lantern, gas lantern, fluorescent tube lamp, camping lamp, entrance door lamp, chandelier, and flash light.

The above-mentioned flexible electro-luminescent panels, strips, tubes, or fibers can be provided by any of a number of commercially available or previously proposed types of electro-luminescent lighting elements, such as the electro-luminescent panels having discrete phosphor coatings disclosed in U.S. Pat. No. 5,572,817, and in copending U.S. patent application Ser. No. 08/729,408 (allowed), Ser. No. 08/734,872 (pending), and Ser. No. 08/746,706 (pending), each of which is incorporated by reference herein, as well as the three-dimensional electro-luminescent tube arrangement disclosed in U.S. patent application Ser. No. 08/758,393, which is also incorporated by reference herein. In addition, the invention can use electro-luminescent strips or elements other than the panels or tubes described above, and may also be used with the optical effects device disclosed in U.S. patent application Ser. No. 08/841,624 (pending), also incorporated herein by reference, which is a continuation of U.S. patent application Ser. No. 08/489,160 (abandoned).

SUMMARY OF THE INVENTION

It is accordingly an objective of the invention to provide a night light having all of the advantages provided by the inclusion of electro-luminescent lighting elements, including brightness, color choice, and the ability to exhibit a variety of special effects including, in the case of discrete phosphor panels, multi-color and motion effects, and which also provides additional lighting functions so that the user can obtain the advantages of both conventional and electro-luminescent lighting elements in a single device.

It is a further objective of the invention to provide a variety of different types of lighting arrangements with additional night light functions, and to provide night lights that can be used to provide conventional types of lighting, without greatly increasing the complexity of either the night light or conventional lighting arrangements.

It is a further objective of the invention to provide an electro-luminescent night-light/conventional-lighting-device combination that utilizes state-of-the art electro-luminescent lighting technology to maximize design possibilities from both a performance and aesthetic standpoint.

These objectives are achieved, in accordance with the principles of a first preferred embodiment of the invention, by combining a flashlight with an electro-luminescent night light, the flash light including a conventional incandescent lighting element powered by the battery, a light emitting diode also powered by the battery to provide a power fail or low power/low battery level indicator function, and an electro-luminescent element powered by retractable prongs that may be plugged into an electrical outlet in the manner of a conventional night light.

In accordance with the principles of a second preferred embodiment of the invention, the flashlight function is provided by a light emitting diode or an incandescent/halogen lighting element and the power fail or low power/low battery level indicator function may be omitted to provide a simpler and more compact device.

In accordance with the principles of a third preferred embodiment of the invention, the flashlight utilizes three-dimensional electro-luminescent lighting elements to provide a more unique night light design, which can be used for example as a traffic control baton, while in accordance with the principles of a fourth preferred embodiment of the invention, multiple electro-luminescent panels or strips are used to provide a desired design.

In accordance with the principles of a fifth preferred embodiment of the invention, the electro-luminescent element is incorporated into an transparent flashlight housing, which can be arranged to provide lensing or other optical effects to increase visibility or attractiveness.

In accordance with the principles of a sixth preferred embodiment of the invention, an electro-luminescent night light with retractable prongs is combined with a fluorescent tube lighting fixture, including a ballast arrangement and a sensor that can provide such functions as power fail, flood, fire, earthquake, cold, or other environmental warnings using an electrical or mechanical moisture, temperature, light, motion, tilt, or other condition-responsive sensor to cause either the electro-luminescent element or the other lighting element to turn on or off, or exhibit effects such as flashing, to provide a warning or indicator function.

In accordance with a seventh preferred embodiment of the invention, the electro-luminescent night light is combined with a camping lantern and radio tuner or other audio device, including a torch light such as a mercury-vapor or halogen lantern, a fluorescent tube light, a power outlet strip illuminated by one or more electro-luminescent lighting elements, an audio device illustrated as a tuner, but which could also be a tape player, compact disc player, or the like, and even a tool holder.

In accordance with a eighth preferred embodiment of the invention, the night light is combined with a conventional lamp, in a manner similar to that disclosed in copending U.S. patent application Ser. No. 08/959,463, while in accordance with the principles of an ninth preferred embodiment of the invention, the night light is combined with a wall lamp and includes multiple types of electro-luminescent lighting elements, and in a tenth preferred embodiment of the invention, the electro-luminescent night light is combined with a floor lamp utilizing multiple types of electro-luminescent elements.

Finally, in accordance with eleventh and twelfth embodiments of the invention, the electro-luminescent night light is combined, respectively, with a fluorescent tube desk lamp and a fuel, wax, or oil powered lamp.

It will of course be appreciated by those skilled in the art that the specific embodiments illustrated in the drawings and described in detail herein represent only a few of the numerous different combinations to which the principles of the invention may be applied, and that the invention is not to be limited to any particular type of electro-luminescent elements, other lighting elements, or lighting devices or contexts, except as provided for in the appended claims.

DETAILED DESCRIPTION OF THE PREFERRED EMBODIMENTS

Figure 1:
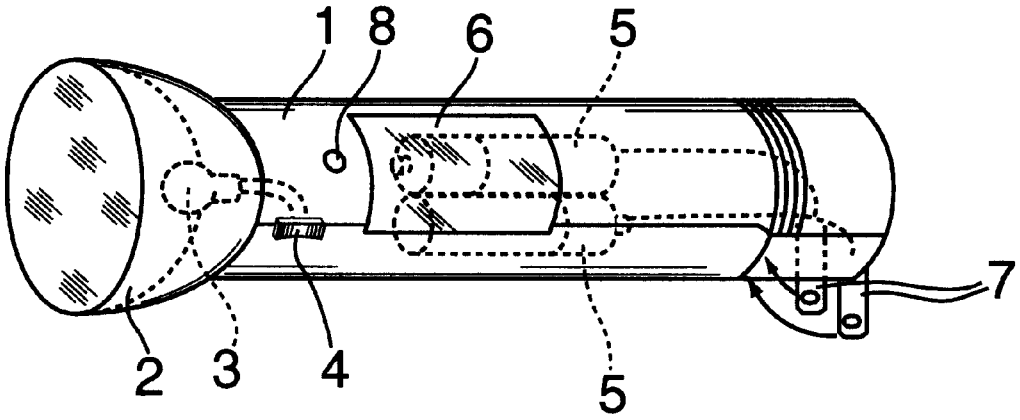
FIG. 1 is an isometric view of a flashlight/electro-luminescent night light combination constructed in accordance with the principles of a first preferred embodiment of the invention.

The flashlight/electro-luminescent night light combination of FIG. 1 includes a substantially cylindrical flashlight housing 1 including a forward reflector portion 2 in which is situated an incandescent or halogen flashlight bulb 3 connected by wires or other appropriate conductors to an on/off switch 4 and batteries 5. The construction of these elements may be identical to those of a conventional flashlight.

In addition to the conventional flashlight elements, however, the combination of this embodiment includes an electro-luminescent element 6 in the form of a flexible panel that emits a relatively soft light in order to perform a night light function. The electro-luminescent element 6 is connected by wires or other conductors as appropriate to prongs 7 which are arranged to be inserted into a corresponding electrical outlet and to thereby provide AC power to the electro-luminescent element. If the batteries are rechargeable, they may also be supplied with power by prongs 7 when the prongs are plugged into the electrical outlet.

Prongs 7 are preferably arranged to retract, either by pivoting into the cylindrical housing 1, or otherwise retracting into the housing 1 so that when the combination device is not plugged into an electrical outlet, it can be held like a conventional flashlight.

In addition to the incandescent bulb, which functions in the manner of a conventional flashlight bulb, and the electro-luminescent element, which operates continuously when the combination device is connected to an external power source, the device illustrated in FIG. 1 includes an LED indicator 8 which may be connected to a circuit (not shown) for connecting the LED to a battery in case the device is plugged into a wall outlet or otherwise connected to an external power source and a power failure occurs. Such circuits are well-known and can easily be included in the device illustrated in FIG. 1.

It will be appreciated by those skilled in the art that the battery type may of course be varied within the scope of the invention and may include alkaline or other non-rechargeable batteries, as well as rechargeable batteries of various types. In addition, rather than being designed to plug into a wall outlet, or in addition to the prongs arranged to plug into the wall outlet, the combination device of this embodiment may include solar cells, or be connectable to other power sources such as windmills and other types of generators.

In addition, as indicated above, the electro-luminescent element may take a variety of forms, including multiple phosphor panels and three-dimensional electro-luminescent elements. Suitable control circuits for the electro-luminescent element are disclosed in numerous prior patents, and it is intended that the invention not be limited to any particular electrical control or switching circuit for turning the electro-luminescent and/or additional lighting element on and off according to a desired pattern or timing.

Figure 2:
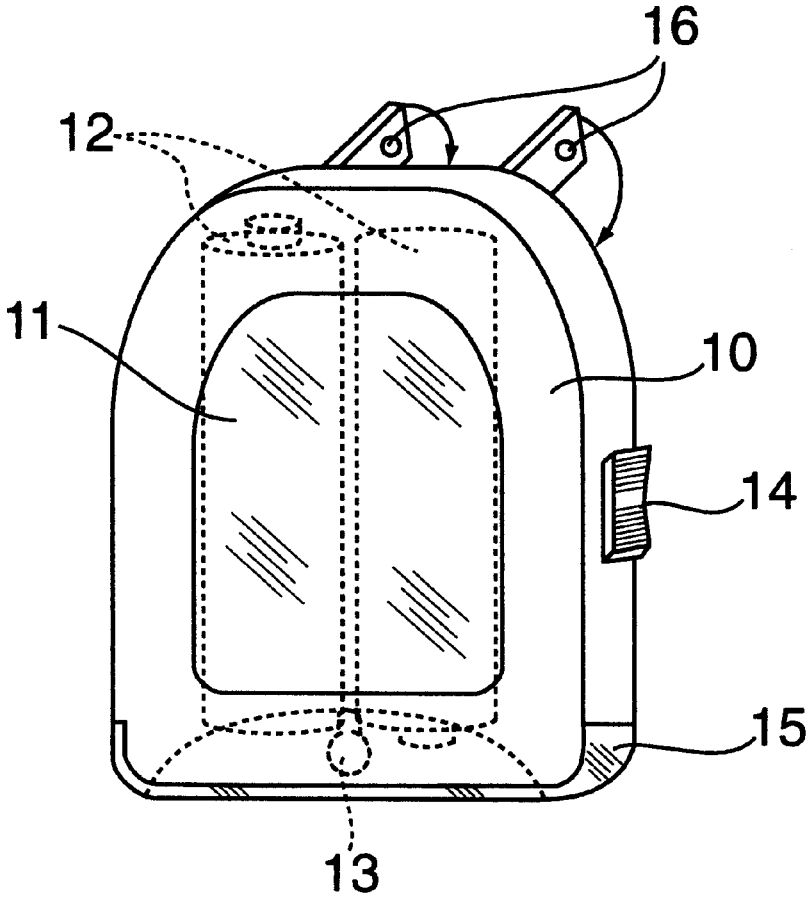
FIG. 2 is an isometric view of a flashlight/electro-luminescent night light combination constructed in accordance with the principles of a second preferred embodiment of the invention.

As shown in FIG. 2, the flashlight/night light combination device housing 10 is shaped more like a conventional night light, but like the embodiment of FIG. 1, the device includes a panel type electro-luminescent element 11 (or elements), batteries 12, an incandescent, halogen, or light emitting diode flashlight bulb 13, and a switch 14, all of which may be similar or identical to corresponding elements described above in connection with FIG. 1. In addition, the device of this embodiment may included a flashlight monitoring element 15 and retractable prongs 16 that permit the device to be plugged into a wall outlet to provide an electro-luminescent night light in the manner disclosed, for example, in copending U.S. patent application Ser. No. 08/910,212, and to be operated as a conventional flashlight when the device is unplugged from the wall outlet and the prongs are retracted. Unlike the embodiment of FIG. 1, this embodiment omits the LED warning light and corresponding circuitry although such a light and circuitry may of course be included in this embodiment if desired.

Figure 3:
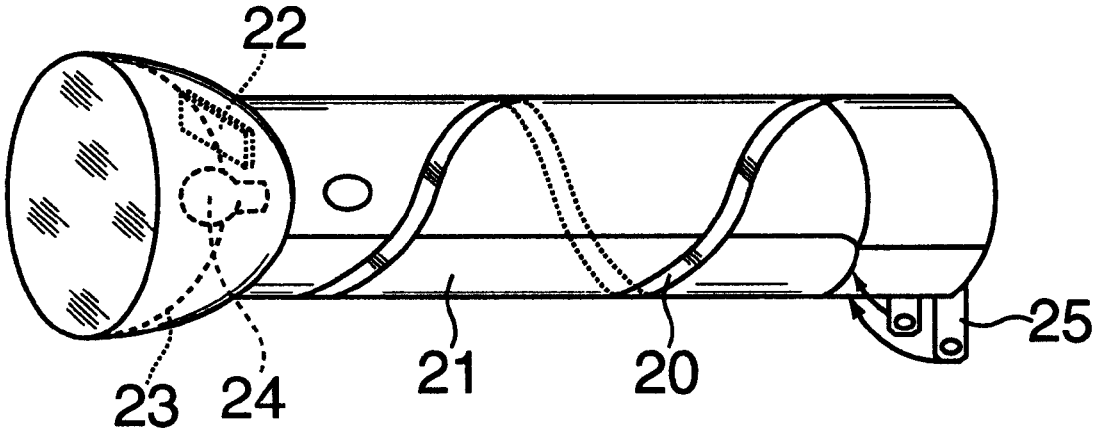
FIG. 3 is an isometric view of a flashlight/electro-luminescent night light combination constructed in accordance with the principles of a third preferred embodiment of the invention.
Figure 4:
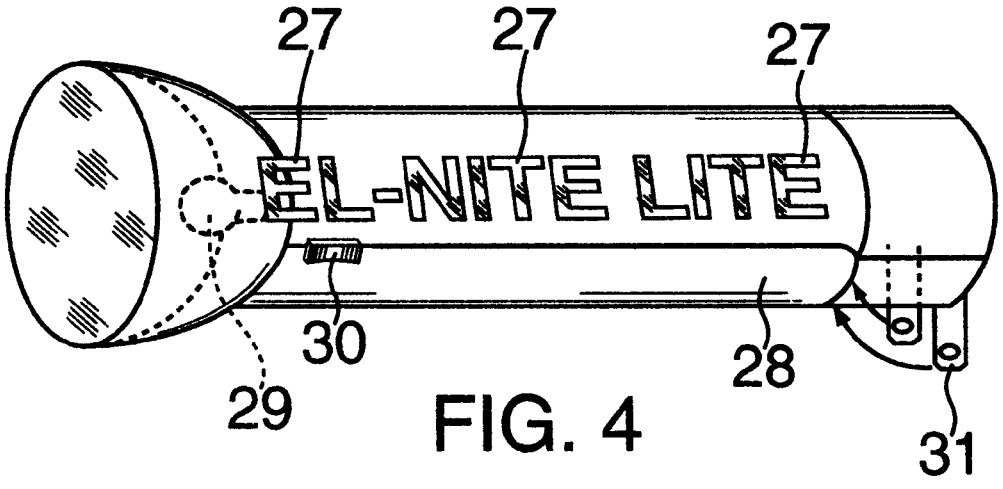
FIG. 4 is an isometric view of a flashlight/electro-luminescent night light combination constructed in accordance with the principles of a fourth preferred embodiment of the invention.

The embodiments of FIGS. 3 and 4 are similar to those of FIG. 1, except that the arrangement of the electro-luminescent night light elements has been varied by substituting, in the embodiment of FIG. 3, one or more electro-luminescent fibers 20 of the type disclosed in copending U.S. patent Ser. No. 08/758,393, which are preferably mounted in grooves or indents formed in the cylindrical body 21. In this embodiment, an inverter circuit 22 is illustrated as being situated in the reflector housing 23, which is also housing the flashlight bulb 24, although those skilled in the art will appreciate that numerous different types of circuits, functions interfaces, and the like may be connected between the electro-luminescent elements and the retractable plug 25 or other power source connectors. The embodiment of FIG. 4 is similar to that of FIG. 3, except that the three dimensional elements are replaced by panels, strips, or tubes 27 that form logos, indicia, or other designs on the body 28 of the flashlight, which also flashlight bulb 29, switch 30, and retractable prongs 31. In both embodiments, the warning LED is illustrated as being omitted, although it could of course be included as in the embodiment of FIG. 1.

Figure 5:
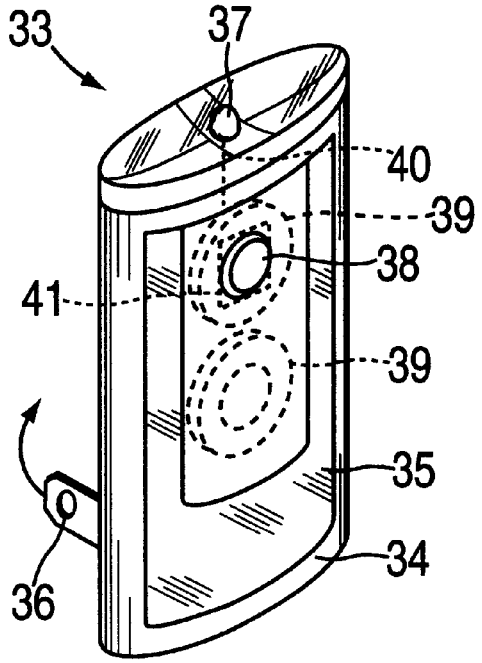
FIG. 5 is an isometric view of a flash light/electro-luminescent night light combination constructed in accordance with the principles of a fifth preferred embodiment of the invention.
Figure 6:
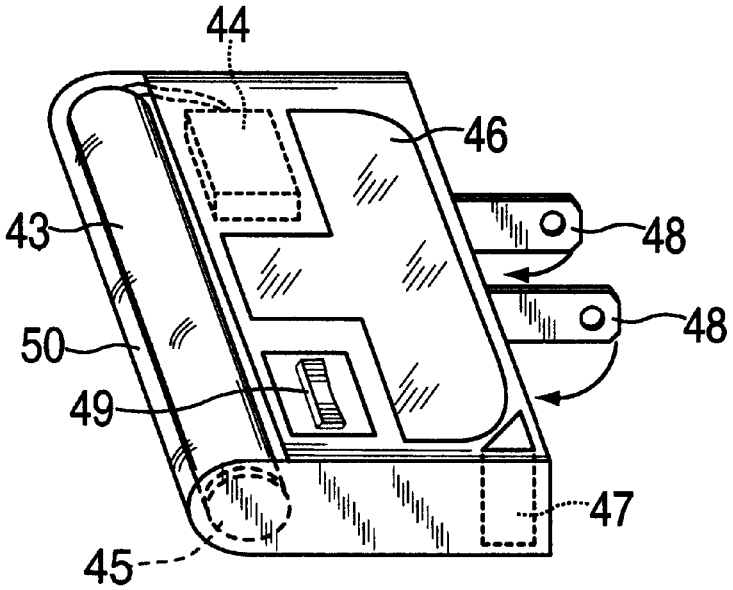
FIG. 6 is an isometric view of a fluorescent light/electro-luminescent night light constructed in accordance with the principles of a sixth preferred embodiment of the invention.

The embodiments of FIGS. 5 and 6 also utilize the principles described above in connection with the embodiment of FIG. 1. FIG. 3 shows a type of flashlight 33 known as the "super slime" flash light, which is an ultra-compact light emitting diode flash light having a plastic body 34 into which, according to the principles of the invention, is housed or molded or otherwise held electro-luminescent panels 35 arranged to illuminate when retractable prongs 36 or other connectors are inserted into an electrical outlet or other power source, and a light emitting diode 37 controlled by a switch 38 connected to a button cell or lithium battery 39 for use as a conventional flashlight when the prongs or other connectors are removed from the outlet or other power source and preferably retracted. As illustrated, one of the leads 40 of the light emitting diode is conveniently located adjacent one of the electrodes 41 of batteries 39 and mechanically connected to switch 38 so as to be moved into or out of engagement with the battery in order to effect switching of the light emitting diode on and off.

The flashlight/night light of FIG. 6 differs from those of FIGS. 1–5 in that the additional lighting element is a fluorescent tube 43 provided, as is conventional, with a ballast 44 and tube holder 45. As illustrated, the electro-luminescent element is a flat panel 46, which may consist of multiple electro-luminescent elements of the same or different colors, although it may of course be varied as described above, and the arrangement further includes an inverter or other circuitry 47 of supplying power to the electro-luminescent element, as well as retractable prongs 48, and a switch and/or sensor element 49 similar to the one described in connection with the embodiment of FIG. 2, all included in a single common housing 50.

Figure 7:
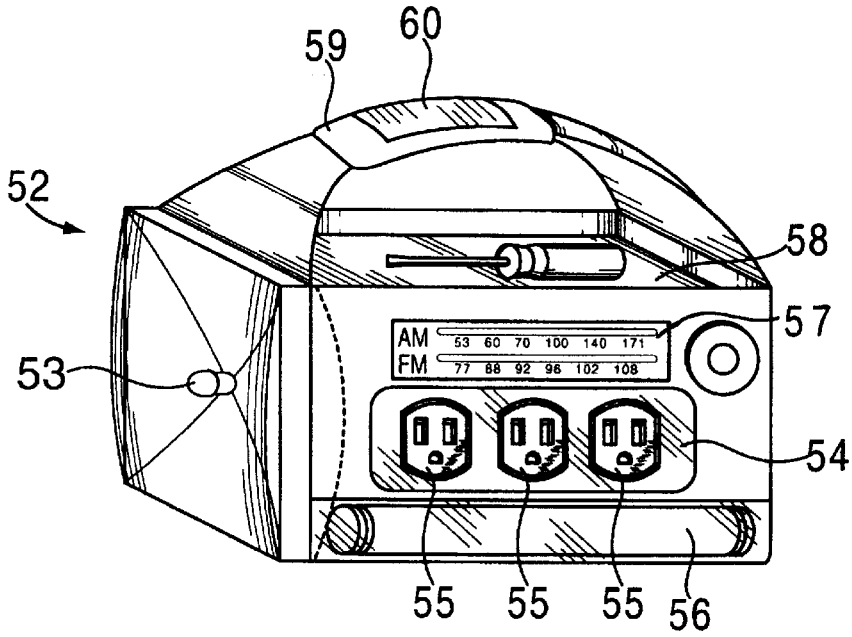
FIG. 7 is an isometric view of a multiple function camping lantern constructed in accordance with the principles of a seventh preferred embodiment of the invention.

The embodiment illustrated in FIG. 7 is a lantern 52 including a mercury-vapor or halogen torch light 53 of the type commonly used in lanterns intended for outdoors use, such as for camping. Like the embodiments of FIGS. 1–6, the conventional lighting element is combined with at least one electro-luminescent element 54, in this case illustrated as surrounded a plurality of electrical outlets 55 within the lantern, though the electrical outlets could be omitted and the electro-luminescent elements could be placed anywhere on the lantern. In addition, the device of FIG. 7 is illustrated as including a fluorescent tube 56 light, a radio 57 or other audio device such as a cassette or compact disc player, a tool holder 58, and a handle 59 on which may be placed an additional electro-luminescent element 60.

Figure 8:
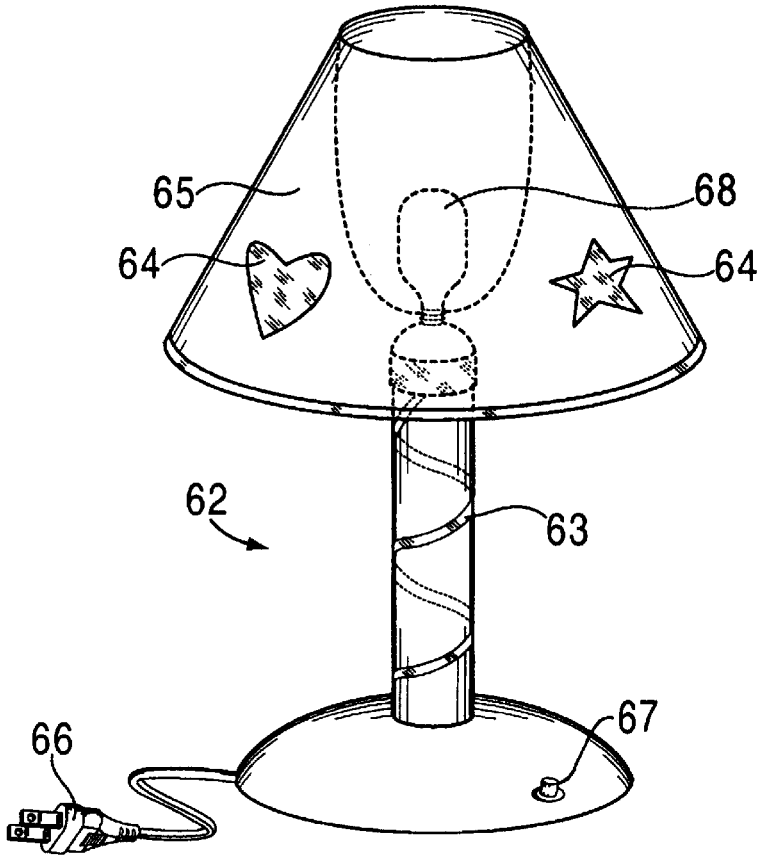
FIG. 8 is a perspective view of a table lamp constructed in accordance with the principles of an eighth preferred embodiment of the invention.

The combination lighting and night light arrangement of FIG. 8 is a table lamp, which may be similar to that described in copending U.S. patent application Ser. No. 08/959,463, and includes an incandescent light bulb and conventional lamp fixture 62, a three-dimensional electro-luminescent fiber 63 wrapped around the lamp post, electro-luminescent strips or panels 64 on the lamp shade 65, a plug or other connector 66 arranged to be plugged into a wall outlet or other power source, and a three position switch 67. The three position switch allows either the light bulb 68 or one or more of the electro-luminescent elements 63, 64 to be turned on using conventional circuitry that can easily be implemented by those skilled in the art, for example using wiring arrangements similar to those shown in the copending application, which is incorporated herein by reference.

Figure 9:
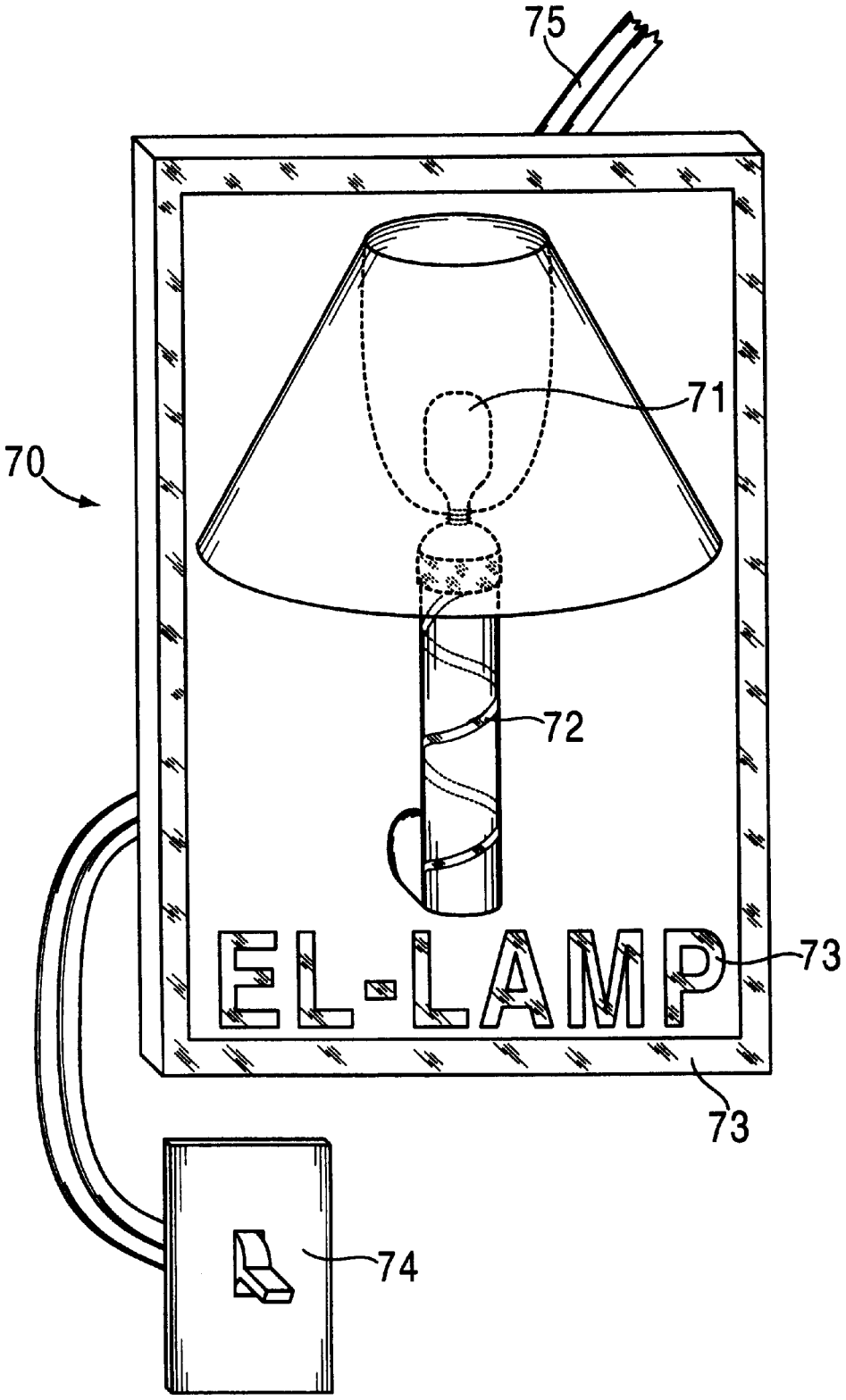
FIG. 9 is an isometric view of a wall lamp constructed in accordance with the principles of a ninth preferred embodiment of the invention.

In the embodiment of FIG. 9, which is a wall lamp 70, the respective conventional non-electro-luminescent bulb 71, which may be an incandescent bulb, a fluorescent light, a neon lighting arrangement, and so forth, and the electro-luminescent elements including electro-luminescent fiber 72 and various strips or panels 73, may be selectively turned on by either a two-way or three-way wall switch 74, the lighting elements being directly wired by wires 75 to a power source or other lights or electrical devices, or connected to the power source through the wall switch. In addition, the switch may be replaced by or include a remote control unit of known type, and may further include a timer unit to initiate various lighting functions at desired times.

Figure 10:
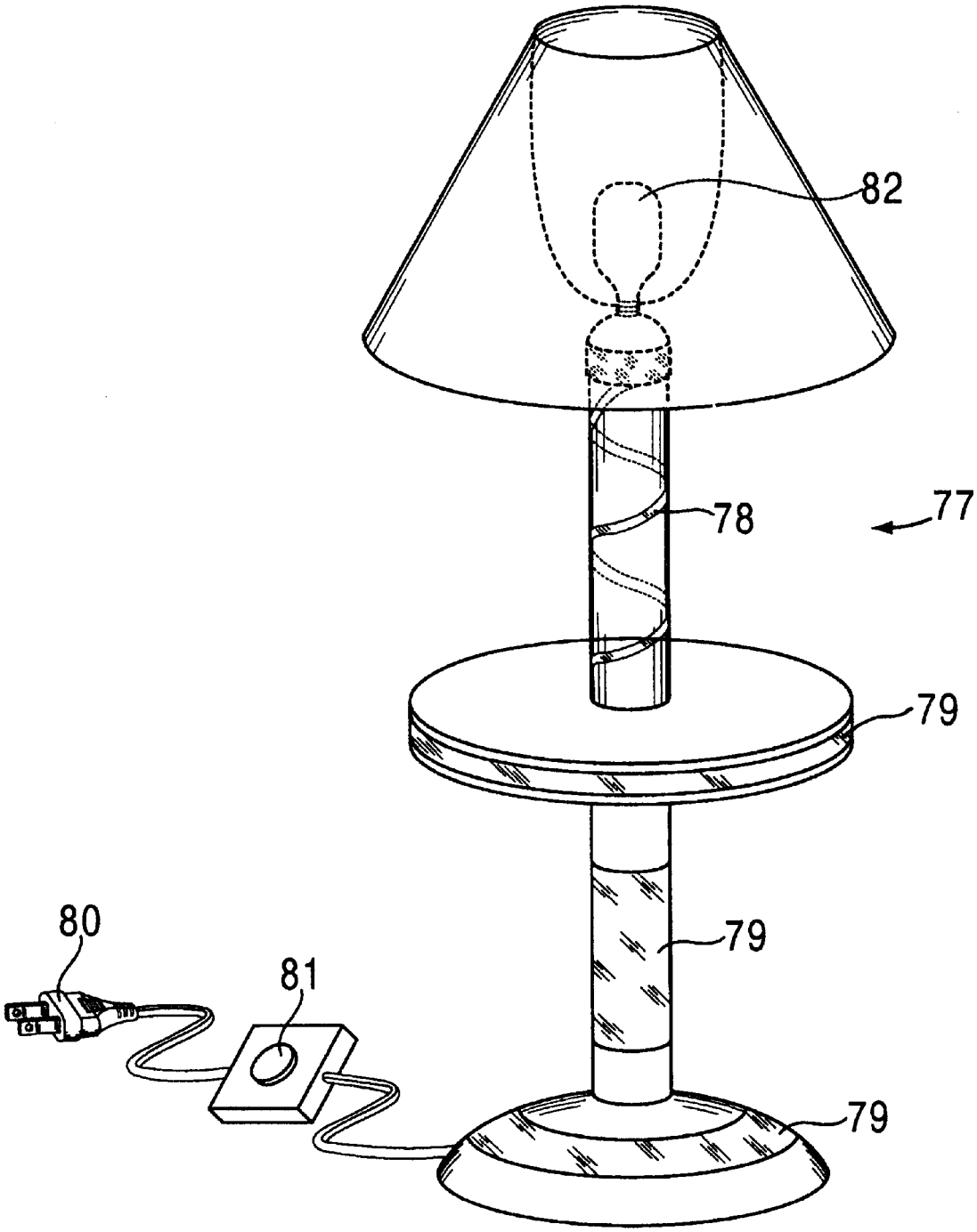
FIG. 10 is an isometric view of a floor lamp constructed in accordance with the principles of a tenth preferred embodiment of the invention.

The embodiment of FIG. 10 is similar to that of FIG. 8, except that the lamp is a floor lamp 77 having an electro-luminescent fiber 78 and electro-luminescent strips or panels 79, a conventional power plug or other connector 80 for insertion into an AC outlet or other power source outlet, and optionally, an electrical or electromechanical switch 81 that may, optionally, also provide dimmer functions for the additional lighting element 82.

Figure 11:
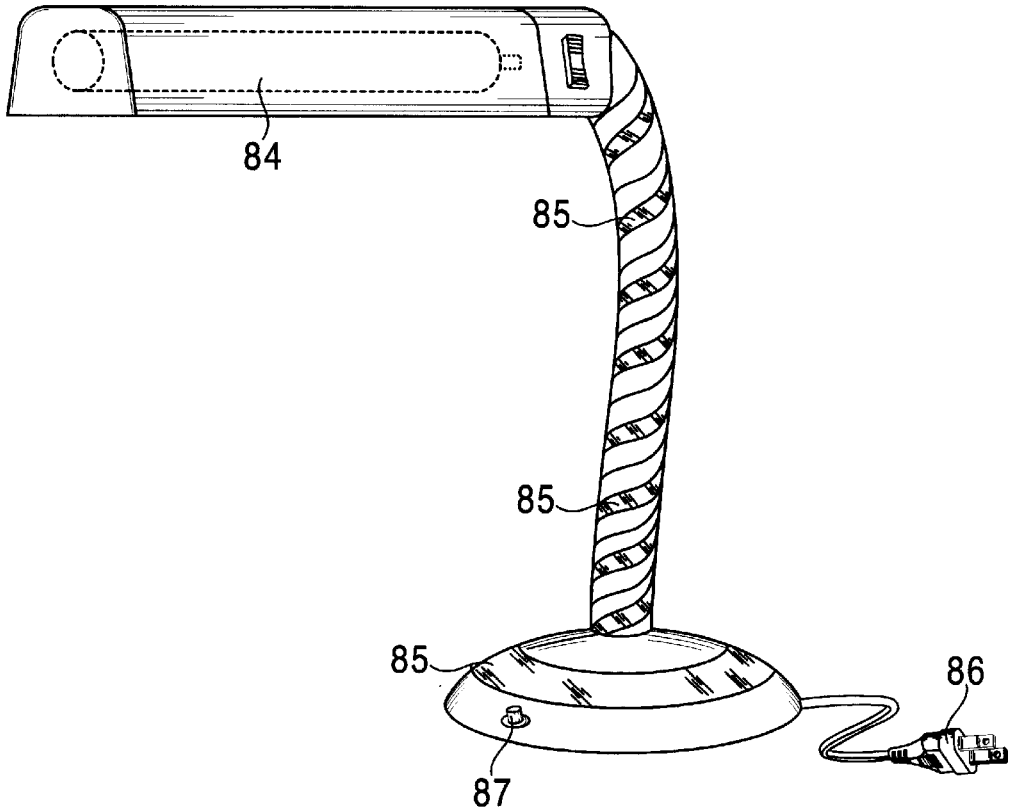
FIG. 11 is a perspective view of a fluorescent desk lamp constructed in accordance with the principles of an eleventh preferred embodiment of the invention.

In the embodiment of FIG. 11, the additional lighting element is a fluorescent tube 84 having a ballast or other electrical power device, a flexible support 85 to adjust the position of the tube 84, electro-luminescent strips, panels, tubes, or fibers 85, a power connector 86, and a twist or push type switch 87 with an optional remote control function.

Figure 12:
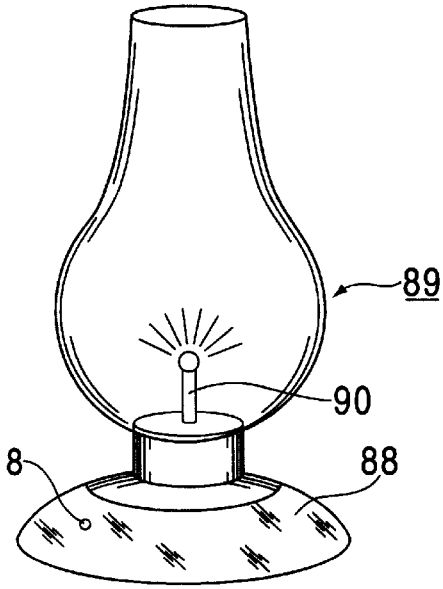
FIG. 12 is an isometric view of a non-electrically powered lighting fixture/electro-luminescent night light combination constructed in accordance with the principles of a preferred embodiment of the invention.

Finally, in the embodiment of FIG. 12, the electro-luminescent element or elements 88, as well as the LED indicator 8 previously discussed with reference to FIG. 1, are combined with a non-electrically powered lamp 89, such as a kerosene, or other gas, oil, or wax powered lamp in which illumination is provided by burning of fuel 90 in the lamp. In this embodiment, the electro-luminescent element 88 and the LED 8 are preferably powered by batteries (not shown) located within the base of the lamp.

As is evident from the above descriptions of the different embodiments of the invention, the concept of the electro-luminescent night light can be extended to numerous different applications by adding different types of lighting elements which are in addition to the electro-luminescent lighting elements, thereby providing night light functions as well as other illumination functions, including flash light, lamp, and indicator functions, depending on the type of additional lighting elements used. The invention is of course not limited to any particular type of such additional lighting elements, or to any particular type of electro-luminescent elements, although flexible electro-luminescent strips, panels, tubes, or fibers are the most practical and convenient types of electro-luminescent lighting elements for purposes of the present invention as represented by the illustrated embodiments.

Having thus described several preferred embodiments of the invention and a number of different variations and modifications of the preferred embodiments, it is anticipated that still further variations and modifications will undoubtedly occur to those skilled in the art upon reading the above description, and it is therefore intended that the invention be interpreted solely in accordance with the appended claims.

I claim:

1. A multiple function light device, comprising:

an electro-luminescent lighting element;

an additional lighting element, said additional lighting element having a different brightness so as to provide different lighting functions than the electro-luminescent light element;

both said electro-luminescent element and said additional lighting element being powered by the same current from a direct current power source; and a third lighting element powered by burning a flammable material.

* * * * *